United States Patent [19]

Lavigne, Jr. et al.

[11] 4,171,623

[45] Oct. 23, 1979

[54] THERMAL ECONOMIZER APPLICATION FOR A CENTRIFUGAL REFRIGERATION MACHINE

[75] Inventors: William J. Lavigne, Jr., Fayetteville; Louis H. Leonard, DeWitt, both of N.Y.

[73] Assignee: Carrier Corporation, Syracuse, N.Y.

[21] Appl. No.: 828,448

[22] Filed: Aug. 29, 1977

[51] Int. Cl.[2] ..... F25B 41/00; F25B 5/00; F25B 41/04; F25B 43/02

[52] U.S. Cl. ..... 62/196 A; 62/117; 62/219; 62/471

[58] Field of Search ..... 62/115, 117, 174, 219, 62/504, 505, 510, 512, 476, 498, 238, 196 A

[56] References Cited

U.S. PATENT DOCUMENTS

| | | | |
|---|---|---|---|
| 2,277,647 | 2/1942 | Zwickl | 62/117 |
| 2,684,579 | 7/1954 | Hieatt et al. | 62/471 |
| 3,165,905 | 1/1965 | Ware | 62/219 |
| 3,226,940 | 1/1966 | Jekat et al. | 62/117 |
| 3,232,074 | 2/1966 | Weller et al. | 62/117 |
| 3,553,974 | 1/1971 | Osborne | 62/115 |
| 3,665,724 | 5/1972 | Anderson et al. | 62/196 |
| 4,014,182 | 3/1977 | Granryd | 62/117 |

*Primary Examiner*—Lloyd L. King
*Attorney, Agent, or Firm*—J. Raymond Curtin; Robert P. Hayter

[57] ABSTRACT

A vapor compression refrigeration system which has a multi-stage compressor, a condenser, a flash economizer, an economizer-condenser, a thermal economizer and a chiller. Liquid refrigerant is flashed in the flash economizer such that part of the liquid refrigerant changes state from a liquid to a gas absorbing heat from the remaining liquid refrigerant, the gaseous refrigerant being drawn into the compressor between stages or being condensed by the economizer-condenser within the flash economizer. An economizer damper valve is provided between the compressor and the flash economizer to regulate this flow of gaseous refrigerant to the compressor depending upon the thermal capability of the economizer-condenser to recondense the flashed refrigerant of the flash economizer.

9 Claims, 1 Drawing Figure

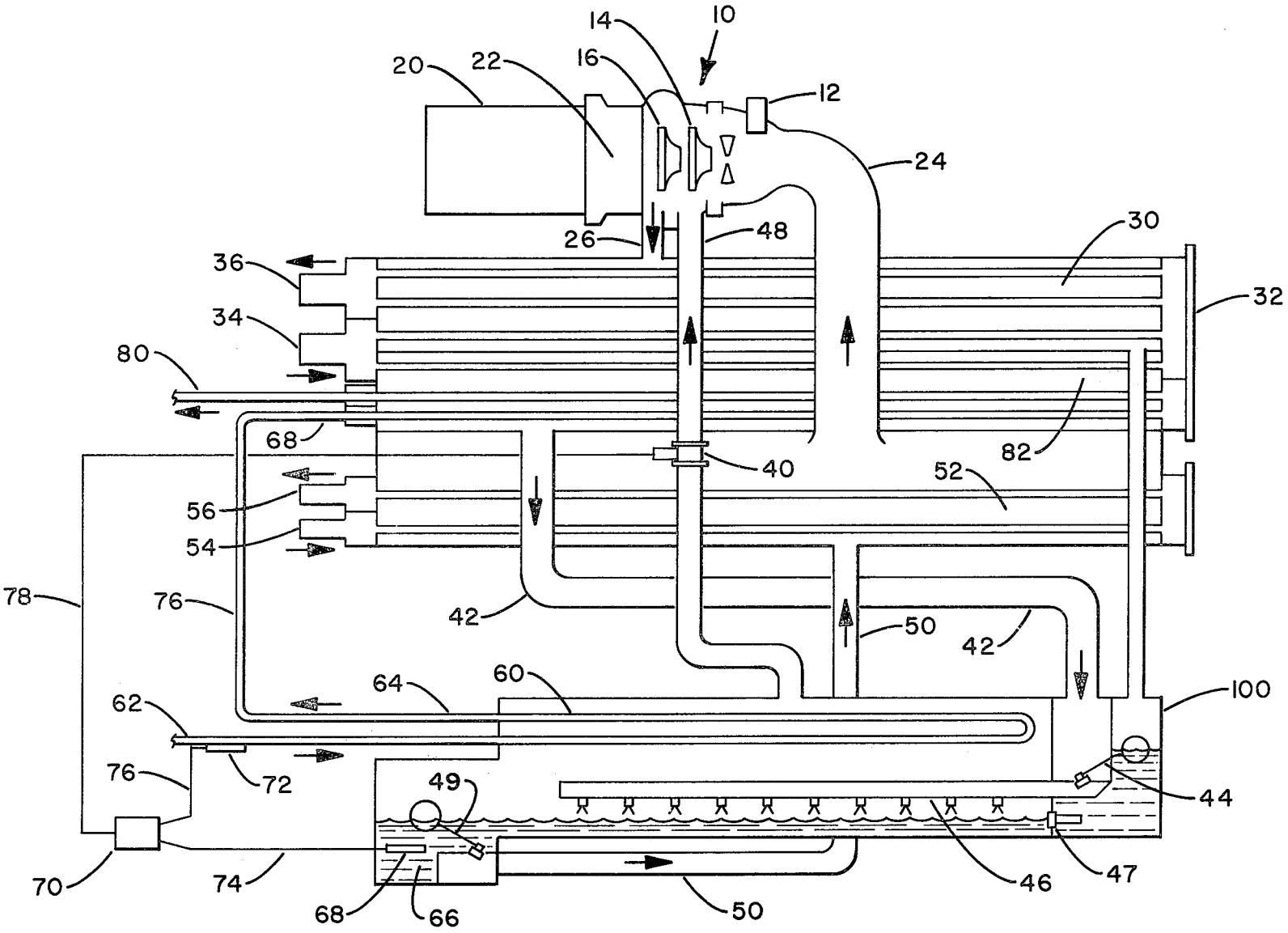
10
12
14
16
20
22
24
26
30
32
34
36
40
42
44
46
47
48
49
50
52
54
56
60
62
64
66
68
70
72
74
76
78
80
82
100

THERMAL ECONOMIZER APPLICATION FOR A CENTRIFUGAL REFRIGERATION MACHINE

BACKGROUND OF THE INVENTION

1. Field of the Invention

The present invention relates to vapor compression refrigeration systems which are adapted to chill a fluid for domestic or other uses. More particularly the present invention relates to vapor compression refrigeration systems which utilize a flash economizer to cool liquid refrigerant.

2. Description of the Prior Art

Refrigeration systems of vapor compression type typically employ a compressor to increase the temperature and pressure of the gaseous refrigerant. Connected thereto is a condenser wherein gaseous refrigerant is cooled so that it may change state to a liquid refrigerant. Thereafter the liquid refrigerant may be cooled in a flash economizer wherein part of the refrigerant is vaporized absorbing heat from the remaining liquid refrigerant. Vaporized refrigerant has been typically drawn into the compressor for recycling through the condenser and liquid refrigerant which has now been cooled passes on to the evaporator or chiller. In the chiller, the refrigerant is evaporated absorbing heat from the fluid to be cooled, the now gaseous refrigerant being drawn into the compressor to complete the cycle.

In the above described refrigeration system, the compressor is a multi-stage compressor such that the flashed refrigerant from the flash economizer may be drawn into the compressor between the stages allowing the flash economizer to be at an intermediate pressure to the condenser and the chiller. The basic patent dealing with the flash economizer was issued to Jones in 1942 and is entitled "Refrigeration", U.S. Pat. No. 2,277,647. Therein the flash economizer was located between the condenser and the evaporator and the flashed gaseous refrigerant therefrom was drawn into the compressor between the first and second stages and the liquid refrigerant which has been cooled in the flashing process is allowed to travel to the evaporator.

Other types of multi-stage compressors have been used with various economizers. In Weller, et al, U.S. Pat. No. 3,232,074, entitled "Cooling Means for Dynamo Electric Machine" there is disclosed an evaporator and a condenser wherein the flash economizer is located therebetween, the flashed gas being drawn into the second stage of a two-stage compressor and liquid refrigerant passing through the condenser and to the machine for cooling of the electric motor. Other economizers are shown in Ware, U.S. Pat. No. 3,165,905; in Osborne, U.S. Pat. No. 3,553,974; in Hieatt, et al, U.S. Pat. No. 2,648,579; and in Anderson, et al, U.S. Pat. No. 3,665,724.

In Jeket, U.S. Pat. No. 3,226,940 an economizer is used with a centrifugal compressor having a combination impeller blade such that the flash gas from the economizer may enter the centrifugal compressor in the middle of the blade thereby creating within a single compressor two separate pressure levels. In Grandryd, U.S. Pat. No. 4,014,182, apparatus is disclosed wherein an economizer is utilized within a single stage compressor such that liquid refrigerant is allowed to flow from the condenser to the economizer wherein gaseous refrigerant is withdrawn into the compressor until such time as the economizer temperature reaches the desired level. At such time a valve opens allowing the refrigerant to be drawn into the chiller from which the compressor removes the flashed refrigerant gas. The compressor runs continuously however the suction line to the compressor is cycled alternately between the economizer and the condenser such that the compressor is steadily drawing refrigerant from either the economizer or the condenser and such that the refrigerant passing from the economizer to the condenser is always at the desired temperature.

A separate method is disclosed herein for removing the flashed refrigerant gas from a flash economizer. This method includes using an economizer-condenser for condensing the gaseous refrigerant to a liquid thereby reducing the pressure within the flash economizer such that additional liquid refrigerant entering the flash economizer may be flashed to absorb heat from the remaining liquid refrigerant. This thermal economized flash economizer system is particularly adaptable to a retrofit market for use with a refrigeration machine having a multi-stage compressor. Furthermore a valve may be located between the compressor and the flash economizer to control the amount of flashed gas drawn from the flash economizer to the compressor. The amount of flashed gas drawn into the compressor as controlled by the valve is dependent on the capability of the economizer condenser to recondense the flashed gas. The valve itself is controlled through a device which senses the temperature differential between the entering cooling fluid for the economizer-condenser and the liquid refrigerant within the flash economizer.

It is necessary to use flash type sub-cooling for certain selected refrigerants. Refrigerants such as R-11 are not readily adaptable to sensible heat sub-cooling and consequently the only satisfactory method of cooling R-11 is by latent heat cooling with a change in state from a liquid to a gas.

For a better explanation of the use of an economizer-condenser with a flash economizer refrigeration system see patent applications entitled "Dual Flash Economizer Refrigeration System", Ser. No. 828,458; "Dual Flash and Thermal Economized Refrigeration System", Ser. No. 828,793; and "Thermal Economized Refrigeration System", Ser. No. 828,449; all filed simultaneously herewith and all assigned to the assignee hereof.

SUMMARY OF THE INVENTION

An object of the present invention is to provide an efficient refrigeration system.

A more specific object of the present invention is to provide a thermal economized refrigeration system.

Another object of the present invention is to provide a vapor compression refrigeration system wherein a refrigerant is flashed for sub-cooling and thereafter the gaseous refrigerant is either recompressed in the compressor or recondensed in the flash economizer.

It is another object of the present invention to condense flashed refrigerant gas in the flash economizer such that a second stage of a multi-staged compressor need not be utilized to recompress said gas.

It is a still further object of the present invention to provide a temperature differential means for controlling a damper valve to regulate the amount the flashed refrigerant gas from the flash economizer that travels to the compressor.

A still further object of the present invention is to regulate the amount of flashed refrigerant gas from the economizer-condenser that travels to the compressor dependent upon the temperature differential between the incoming cooling fluid to the economizer-condenser and the temperature of the liquid refrigerant within the flash economizer.

It is another object of the present invention to provide a thermal economizer which may be adapted to be installed in existing vapor compression refrigeration systems utilizing a multi-stage compressor.

Other objects will be apparent from the description to follow and from the appended claims.

The preceding objects are achieved according to a preferred embodiment of the invention by the provision of a flash economizer within a multi-stage vapor compression refrigeration system. Therein the condenser is connected to the compressor with the condenser condensing the gaseous refrigerant received from the compressor to a liquid refrigerant. A thermal economizer is provided for further reducing the temperature of the liquid refrigerant. Liquid refrigerant then travels from the thermal economizer to the flash economizer wherein part of the liquid refrigerant changes state to a gaseous refrigerant absorbing heat from the remaining liquid refrigerant. Liquid refrigerant then travels to the chiller where it changes state from a liquid to a gas absorbing heat from the fluid to be cooled. The fluid to be cooled is circulated throughout the enclosure to obtain the desired cooling. The gaseous vapor from the chiller is then recycled into the compressor to complete the refrigeration cycle.

The flashed gaseous refrigerant from the flash economizer is either recondensed within the flash economizer by the economizer-condenser or drawn into the compressor between the stages such that the gaseous refrigerant is constantly being removed from the flash economizer to allow liquid refrigerant entering the flash economizer to be flashed as a result of a pressure drop caused by the removal of the gaseous refrigerant. A differential temperature control is provided for sensing the difference in temperature between the incoming economizer condenser cooling fluid and the liquid refrigerant within the flash economizer such that the conduit to the compressor from the flash economizer is controlled by a valve to regulate the amount of flashed refrigerant gas entering the compressor from the flash economizer dependent upon the load capabilities of the economizer condenser.

BRIEF DESCRIPTION OF THE DRAWINGS

The FIGURE is a schematic diagram of a multi-stage vapor compression system utilizing a thermal economizer and an economizer condenser pursuant to the invention.

DESCRIPTION OF THE PREFERRED EMBODIMENT

The embodiment of the invention described below is adapted for use in a vapor compression refrigeration system having a multi-stage compressor, a condenser, a thermal economizer, a flash economizer, an economizer-condenser and a chiller. It is to be understood that the present invention finds applicability in other refrigeration systems than multi-stage vapor compression systems. In particular a flash economizer having an economizer-condenser could be used with a single-stage vapor compression system assuming that the design capabilities of the system were such that the economizer-condenser could meet the requirements for steady state operation of the flash economizer by condensing sufficient quantities of gaseous refrigerant to provide a constant pressure drop for the liquid refrigerant entering the flash economizer. The present invention is further adapted so that multiple condensers are available within a single refrigeration system. These multiple condensers may be used as disclosed herein or in other types of refrigeration systems.

Referring now to the figure which shows in schematic form a diagram of a vapor compression refrigeration system, it can be seen that compressor 10 has a first stage 14 and a second stage 16 indicated thereon by a sketch of two impellers. Vane motor 12 is shown for controlling the amount of refrigerant entering the compressor through compressor inlet 24. The refrigerant being compressed in the compressor is exited through compressor outlet 26 to condenser 30. Condenser 30 has condensing water 34 entering therein for absorbing heat from the gaseous refrigerant so that it changes state to a liquid refrigerant. The condenser water is discharged at outlet 36. The water flows typically through a shell and tube type heat exchanger having header 32 denoted on the diagram. From the condenser the liquid refrigerant flows to thermal economizer 82 wherein the refrigerant is in thermal contact with tubes containing a cooling fluid at a low temperature such that additional heat is absorbed from the refrigerant.

From thermal economizer 82 the liquid refrigerant flows through conduit 42 to flash economizer 100. When sufficient liquid refrigerant builds up at float valve 44 refrigerant is allowed to pass through the float valve to economizer spray pipe 46. Within the flash economizer 100 when float valve 44 is open the liquid refrigerant is sprayed from economizer spray pipe 46 through orifice 48 into the flash economizer 100. The pressure in the flash economizer is less than the saturation pressure of the entering refrigerant and part of the liquid refrigerant therein changes state to a gaseous refrigerant absorbing heat from the remaining liquid refrigerant. The liquid refrigerant is collected in reservoir 66 within flash economizer 100 (or subcooler 100 depending upon the terminology desired) such that when sufficient liquid refrigerant is collected float 49 opens allowing liquid refrigerant to pass through conduit 50 to chiller 52. Within chiller 52 the fluid to be cooled has heat absorbed therefrom as the liquid refrigerant changes state from a liquid to a gas. The fluid to be cooled enters at 54 and is discharged at 56 to the enclosure where the cooled water is utilized. The gaseous refrigerant is withdrawn from chiller 52 into compressor inlet 24 to complete the refrigeration cycle.

Mounted within flash economizer 100 is economizer condenser 60. Also mounted in communication with the flash refrigerant gas within flash economizer or subcooler 100 is conduit 48 which connects the flash economizer with the second stage of the centrifugal compressor 10. Interposed in conduit 48 is economizer damper valve 40 for controlling the volume flow of gaseous refrigerant from the flash economizer to the compressor. Cooling fluid usually city supply water is provided at inlet 62 to economizer-condenser 60 and exits at outlet 64 therefrom after absorbing heat as the gaseous refrigerant is condensed. The same water may travel through conduit 76 to inlet 68 of thermal economizer 82 and be subsequently discharged at outlet 80 of thermal economizer 82. However it is not necessary for this invention to cycle the economizer-condenser cooling fluid thru the thermal economizer.

Differential temperature control 70 is provided such that the temperature sensed by bulb 68 which is connected to temperature differential control by wire 74 (or conduit depending on the nature of the temperature sensing device) and the temperature sensed by bulb 72 which is connected to the differential temperature control 70 by wire 76 are compared such that when a particular differential, 5 degrees for example, is determined economizer damper valve 40 is closed through wire 78 such that the economizer-condenser is then used to condense the flash gas in the flash economizer and none of said gas passes on to the compressor. Bulb 68 senses the temperature of the liquid refrigerant within the flash economizer and bulb 72 senses the temperature of the city water entering the economizer-condenser. When the temperature differential is less than 5 degrees the differential temperature control 70 actuates the economizer damper valve 40 (electrically or hydraulically controlled) such that it is in a partially open or open position depending on the overall value of the temperature differential.

In a normal installation building supply water entering into economizer-condenser 62 is in the temperature range of 45 to 50 degrees Fahrenheit. Typically the flash economizer operates at 70 degrees Fahrenheit such that there is always sufficient temperature differential between the two so that the economizer-condenser may be utilized to condense all of the flashed refrigerant gas and the compressor need not be used to recondense the flashed gas. Usually the water exiting from the economizer-condenser is of sufficiently cool temperature that it still may be used within thermal economizer 82 to further cool the liquid refrigerant from condenser 30.

Many building and commercial applications use a sufficiently large supply of building water or city water such that there is always available a constant flow of cooled water for use within the economizer-condenser. If there is not a sufficient supply for use therein the temperature differential will be minimized and consequently the economizer damper valve 40 will open allowing the compressor to recompress the flashed refrigerant gas. However in hospital or similar type applications the flow of building water entering the building is generally sufficient to meet the demand. Furthermore the inlet water for the building which is passed through the economizer-condenser and the thermal economizer is now heated to some extent and said water may be used within the building water supply and may further save the thermal energy necessary to heat that water at some future time.

In this typical vapor compression application the pressure of the flash economizer is less than the outlet pressure of the compressor and the refrigerant pressure within the chiller is further reduced from that of the flash economizer such that the compressor acts to increase the pressure from that of the chiller to that of the compressor outlet.

The invention has been described in detail with particular reference to preferred embodiment thereof but it will be understood that variations and modifications can be effected within the spirit and the scope of the invention.

What is claimed is:

1. In a vapor compression refrigeration system having a flash type economizer wherein liquid refrigerant is flashed so that part of the liquid refrigerant changes state to a gaseous refrigerant absorbing heat from the remaining liquid refrigerant, a compressor for recompressing flashed refrigerant, and an economizer-condenser for recondensing the flashed refrigerant which comprises:

a heat exchanger in communication with the gaseous refrigerant of the economizer;

means for supplying a cooling fluid to the heat exchanger, said cooling fluid having a temperature below the temperature of the refrigerant in the economizer; and means for controlling the flow of gaseous refrigerant to the compressor from the economizer in conjunction with the amount of flashed refrigerant condensed by the heat exchanger.

2. The invention as set forth in claim 1 wherein the means for supplying a cooling fluid includes connecting the heat exchanger to the city water supply.

3. In an improved vapor compression refrigeration system having a multiple stage compressor, a condenser, a chiller and a flash type economizer wherein liquid refrigerant is partially flashed to the gaseous state, and wherein the gaseous refrigerant from the economizer is drawn through an economizer outlet conduit into the compressor between compression stages, and wherein the liquid refrigerant from the economizer is conducted to the chiller, an economizer-condenser which comprises:

a heat exchanger mounted in communication with the gaseous refrigerant from the economizer;

means for supplying the heat exchanger with a cooling fluid so that heat is absorbed from the gaseous refrigerant converting the gaseous refrigerant to a liquid refrigerant; and means responsive to the temperature differential between the cooling fluid of the heat exchanger and the refrigerant in the economizer for controlling the flow of gaseous refrigerant from the economizer to the compressor.

4. The invention as set forth in claim 3 wherein the means responsive to the temperature differential includes:

a thermostat for sensing the temperature differential between the cooling fluid and the refrigerant in the economizer; and a damper valve situated in the economizer outlet conduit between the economizer and the compressor, said valve being actuated by the thermostat so that it is in the closed position when the temperature differential between the cooling fluid and the refrigerant in the economizer reaches a predetermined level.

5. The invention as set forth in claim 4 wherein the damper valve is in the closed position when during steady state operation, the heat exchanger is capable of condensing the flashed refrigerant gas of the economizer at the same or a greater rate than said flashed gas is produced in the economizer by the flashing process.

6. The invention as set forth in claim 5 wherein the cooling fluid is building supply water.

7. The invention as set forth in claim 3 and further including:

a thermal economizer to cool the refrigerant from the condenser; and means for circuiting the cooling fluid from the economizer condenser to the thermal economizer.

8. In a refrigeration system having a compressor, a condenser, an evaporator, and a flash type economizer connected to the compressor through an economizer outlet conduit, the improved method of removing flashed gaseous refrigerant from the economizer which comprises:

mounting a heat exchanger in communication with the flashed gas of the economizer;

supplying the heat exchanger with a cooling fluid; and controlling the flashed gaseous refrigerant that flows through the economizer outlet conduit to the compressor so that the heat exchanger may be utilized to convert part of the flashed refrigerant gas into the liquid state and simultaneously allowing the remaining flashed refrigerant gas to be drawn into the compressor where it is recompressed.

9. The invention as set forth in claim 8 and further including steps of:

sensing the temperature differential between the cooling fluid and the refrigerant in the economizer; and wherein the step of controlling is a function of the temperature differential so that when the temperature differential reaches a predetermined level all of the flashed refrigerant gas is recondensed in the economizer by the heat exchanger and there is no flow of flashed refrigerant gas to the compressor.

* * * * *